US005150746A

United States Patent [19]

Weil

[11] Patent Number: 5,150,746

[45] Date of Patent: Sep. 29, 1992

[54] FLITCH TABLE

[75] Inventor: George Weil, Mississauga, Canada

[73] Assignee: David R. Webb Co., Inc., Edinburgh, Ind.

[21] Appl. No.: 800,642

[22] Filed: Nov. 27, 1991

Related U.S. Application Data

[63] Continuation-in-part of Ser. No. 702,774, May 17, 1991, Pat. No. 5,101,874.

[51] Int. Cl.[5] ..... B27L 5/02

[52] U.S. Cl. ..... 144/209 B; 144/177; 144/209 R; 144/369

[58] Field of Search ..... 144/177, 178, 209 R, 144/209 A, 209 B, 365, 369

[56] References Cited

U.S. PATENT DOCUMENTS

| | | | |
|---|---|---|---|
| 144,938 | 11/1873 | Williams . | |
| 793,306 | 6/1905 | Koss . | |
| 828,065 | 8/1906 | Smith . | |
| 2,261,497 | 11/1941 | Hill | 144/208 B |
| 3,441,069 | 4/1969 | Koss | 144/309 |
| 3,680,612 | 8/1972 | Hale | 144/178 |
| 3,905,408 | 9/1975 | Hale | 144/178 |
| 4,089,354 | 5/1978 | Cremona | 144/178 |
| 4,313,481 | 2/1982 | Cremona | 144/209 |
| 4,323,101 | 4/1982 | Cremona | 144/323 |
| 4,587,616 | 5/1986 | Weil | 365/475 |

FOREIGN PATENT DOCUMENTS

| | | | |
|---|---|---|---|
| 29479 | 6/1909 | Sweden | 144/209 |

*Primary Examiner*—W. Donald Bray
*Attorney, Agent, or Firm*—Barnes & Thornburg

[57] ABSTRACT

A flitch table is provided for mounting a flitch for slicing of veneer from the flitch by a knife. The flitch includes a mounting side which lies adjacent the table when the flitch is mounted to the table. The mounting side includes grooves which extend generally transversely of the direction of relative movement between the flitch and the knife during the slicing of veneer. The table includes dogs for projecting into the grooves when the flitch is mounted to the table to fix the flitch to the table for slicing of the flitch and guide rails between adjacent dogs longitudinally of the table. The guide rails also project into the grooves when the flitch is mounted to the table. The dogs have a flitch fixing position in which the flitch is fixed to the table by the dogs and a flitch releasing position in which the flitch is not fixed to the table by the dogs. A rack and pinion mechanism drives the dogs between the fixing and releasing positions.

17 Claims, 4 Drawing Sheets

FLITCH TABLE

This is a continuation-in-part of my earlier filed and co-pending U.S. Ser. No. 07/702,774 filed May 17, 1991 titled TANGENTIAL ROTARY SLICER and assigned to the same assignee as this application, now U.S. Pat. No. 5,101,874.

This invention relates to flitch tables for veneer slicers. It is disclosed in the environment of a rotary slicer which has the capability to slice sheets from multiple flitches with each rotation of a flitch carriage, but is believed to be useful in other types of veneer slicers as well.

Veneer slicers are known. There are, for example, the slicers of U.S. Pat. Nos.: 144,938; 793,306; 828,065; 2,261,497; 3,441,069; 3,680,612; 3,905,408; 4,089,354; 4,313,481; 4,323,101, and 4,587,616; and Swedish Patent Specification 29,479. These slicers have flitch tables or log stays for positioning the flitch being sliced on the slicer and maintaining the flitch in position throughout the slicing operation.

According to one aspect of the invention, a flitch table is provided for mounting a flitch for slicing of veneer from the flitch by a knife. The flitch includes a mounting side which lies adjacent the table when the flitch is mounted to the table, the mounting side including an opening. The table includes a dog for projecting into the opening when the flitch is mounted to the table to fix the flitch to the table for slicing of the flitch. The dog has a flitch fixing position in which the flitch is fixed to the table by the dog and a flitch releasing position in which the flitch is not fixed to the table by the dog. Means are provided for driving the dog between the fixing and releasing positions.

Illustratively according to this aspect of the invention, the dog comprises a dogging portion for engaging the flitch adjacent the opening when the dog is in the fixing position.

Further, illustratively, the drive means comprises a drive shaft for rotating the dog between the fixing position and the releasing position.

Additionally, illustratively, the dog comprises a somewhat elliptically shaped head portion. The dogging portion comprises the region of the head portion adjacent either end of the major axis of the elliptically shaped head portion. The drive shaft mounts the dog adjacent the intersection of the major and minor axes of the head portion.

Further, illustratively, the opening comprises a groove extending generally transversely to the direction of relative movement between the flitch and the knife during the slicing of veneer.

Additionally, illustratively, there are a plurality of dogs and a plurality of drive shafts. The dogs are spaced along the length of the groove when the flitch is mounted on the table.

Illustratively according to this aspect of the invention, the drive means substantially simultaneously drives all of the dogs between their fixing positions and their releasing positions.

Illustratively, the flitch table further comprises a guide rail extending between adjacent dogs, the guide rail extending into the groove between the locations at which said adjacent dogs extend into the groove when the flitch is mounted on the table.

Further, illustratively, the flitch comprises a plurality of such grooves extending generally parallel to each other.

Additionally, illustratively, there are a plurality of dogs and a plurality of drive shafts. The dogs are arranged in rows. Each row of dogs extends along the length of one of the grooves when the flitch is mounted on the table.

Further, illustratively, the drive means substantially simultaneously drives all of the dogs between their fixing positions and their releasing positions.

Illustratively, the flitch table comprises guide rails extending between adjacent dogs along the length of one of the grooves when the flitch is mounted on the table. The guide rails extend into respective ones of the grooves between the locations at which said adjacent dogs extend into the respective grooves when the flitch is mounted on the table.

According to another aspect of the invention, a flitch table mounts a flitch for slicing of veneer from the flitch by a knife. The flitch includes a mounting side which lies adjacent to the table when the flitch is mounted to the table. The mounting side includes a groove extending generally transversely of the direction of relative movement between the flitch and the knife during the slicing of veneer. The table includes means defining a guide rail for projecting into the groove when the flitch is mounted to the table to resist stresses on the flitch during placement of the flitch on the table and slicing of the flitch.

Illustratively, according to this aspect of the invention, a dog is provided for fixing the flitch on the table. The dog has a flitch fixing position in which the flitch is fixed to the table by the dog and a flitch releasing position in which the flitch is not fixed to the table by the dog, and a drive shaft for driving the dog between the fixing and releasing positions.

Additionally, illustratively, the flitch comprises a plurality of such grooves extending generally parallel to each other.

Further illustratively, there are a plurality of guide rails for projecting into the grooves when the flitch is mounted to the table to resist stresses on the flitch during placement of the flitch on the table and slicing of the flitch.

Additionally, illustratively, there are a plurality of dogs. The dogs are arranged in rows. Each row of dogs extends along a guide rail.

The invention may best be understood by referring to the following description and accompanying drawings which illustrate the invention. In the drawings.

Figure 1:
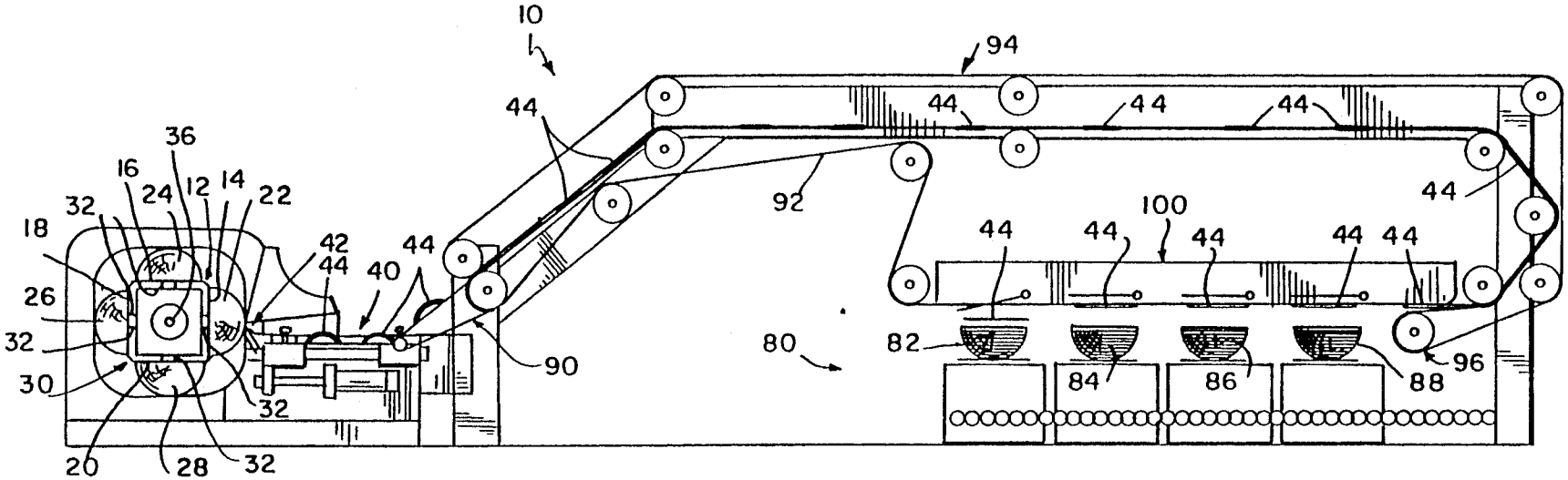
FIG. 1 illustrates a side elevational view of a system according to the present invention.
Figure 2:
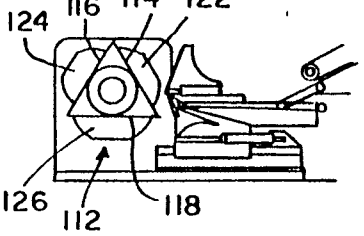
FIG. 2 illustrates an alternative detail to a detail of the system illustrated in FIG. 1.
Figure 3A:
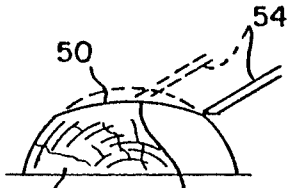
Figure 3B:
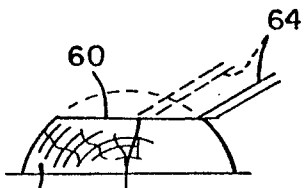
Figure 3C:
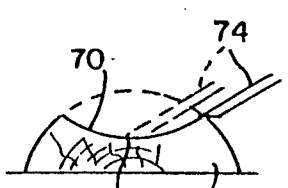
Figure 4:
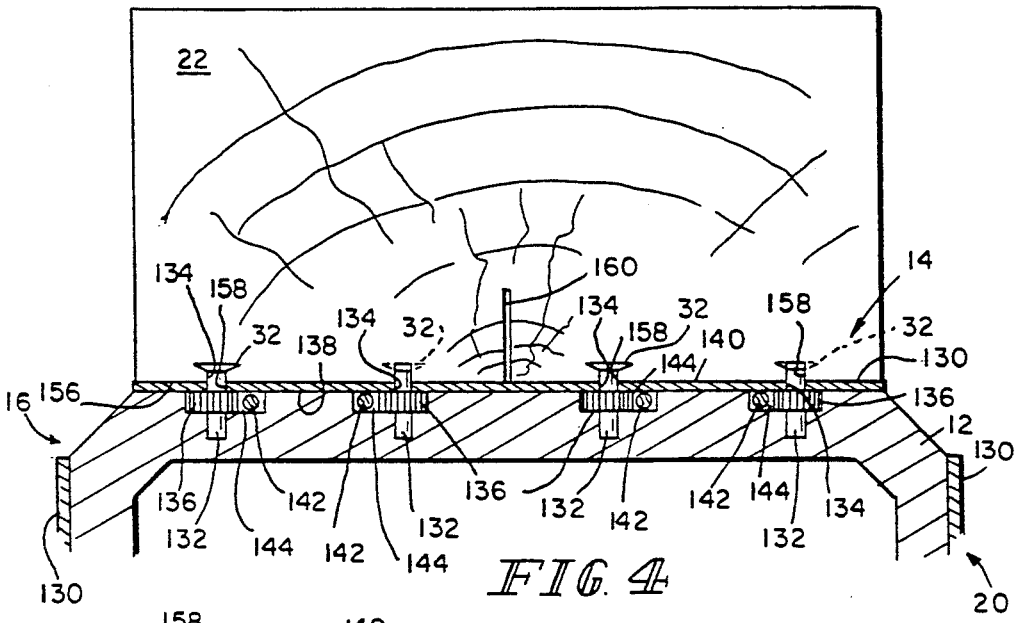
Figure 5:
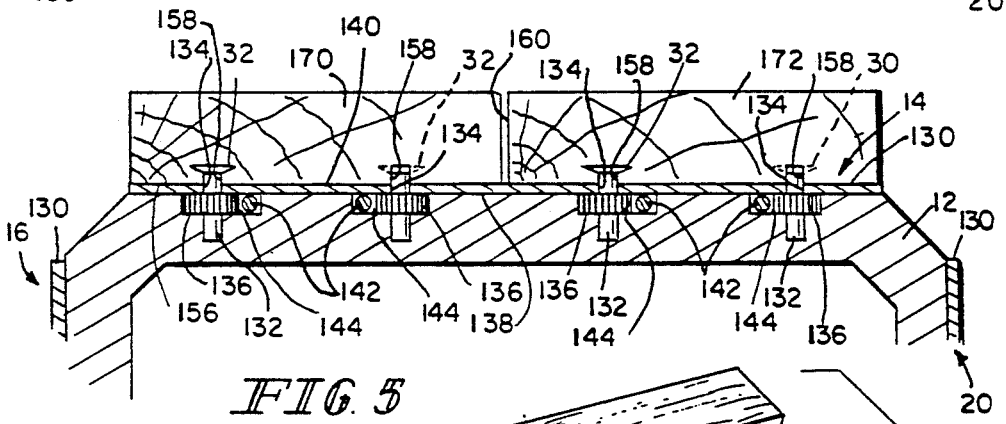
Figure 6:
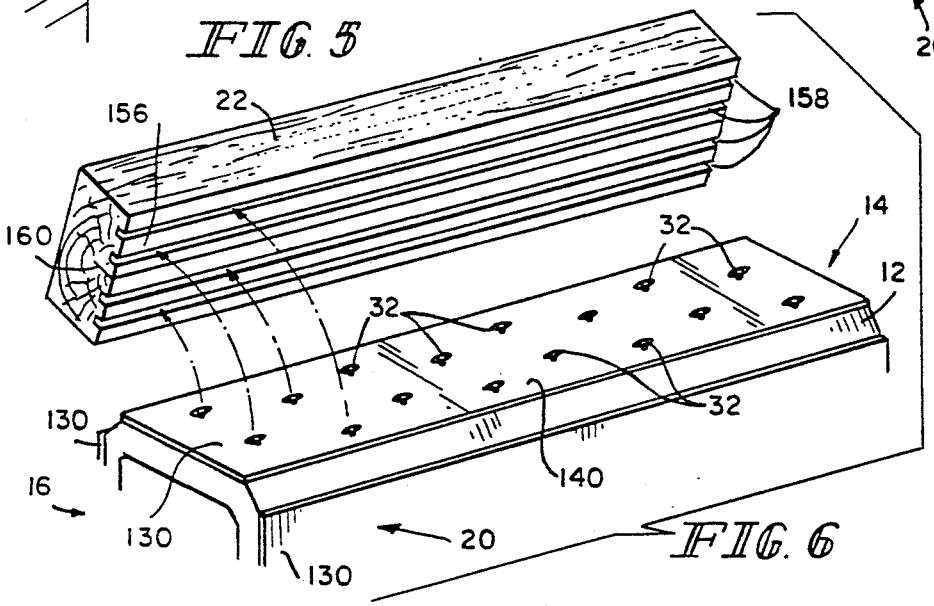
Figure 8:
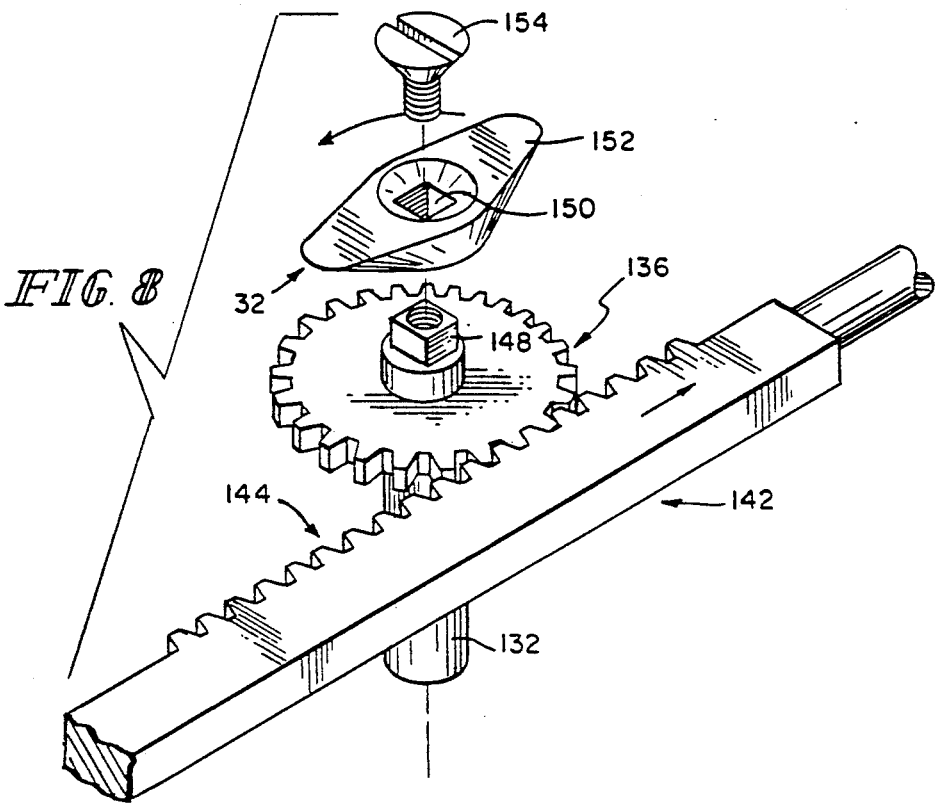
Figure 7:
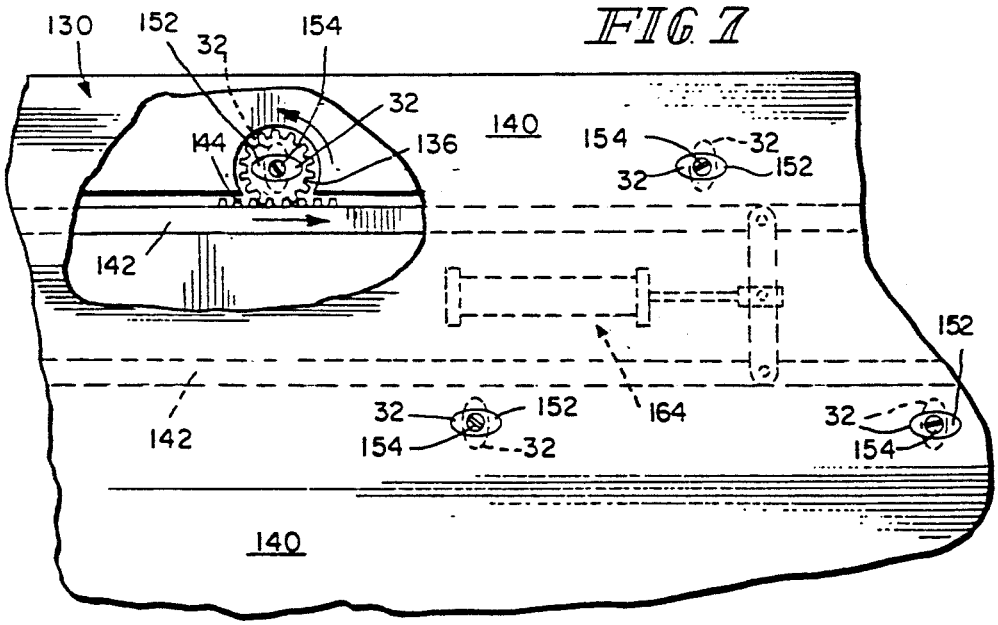
Figure 9:
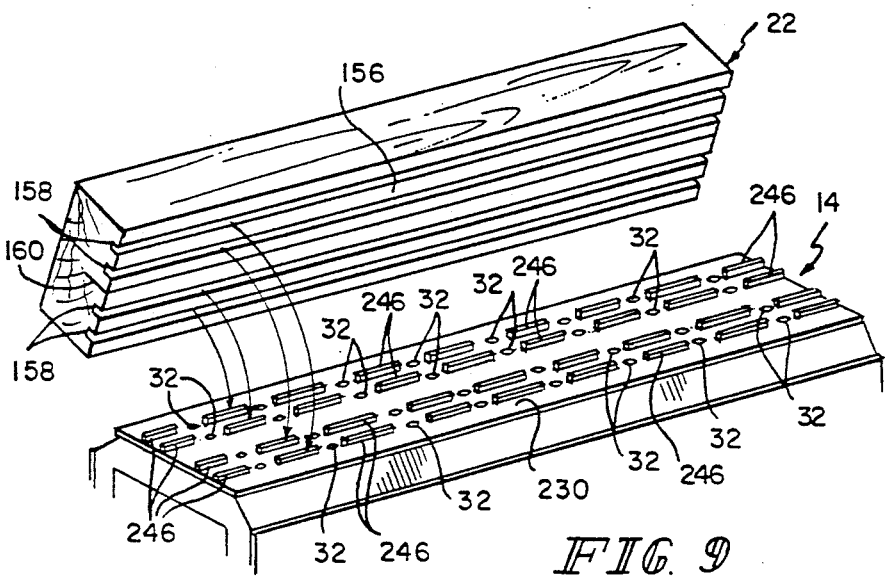
Figure 10:
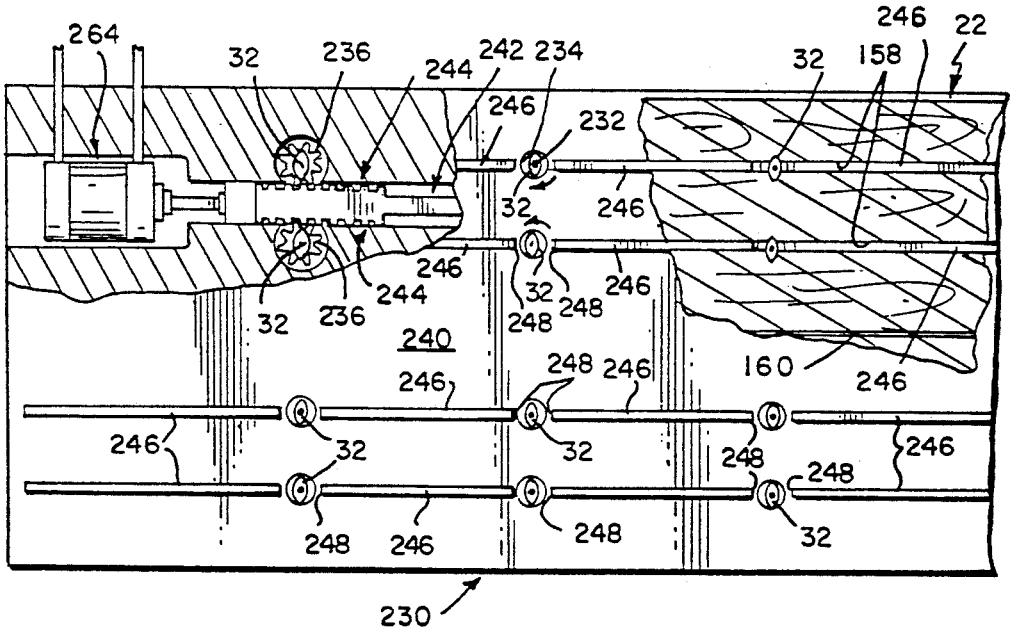

FIGS. 3*a–c* illustrate three different cutting profiles of which the system of FIGS. 1–2 is capable;

FIG. 4 illustrates fragmentarily an enlarged detail of the system illustrated in FIG. 1 at the beginning of a slicing operation;

FIG. 5 illustrates fragmentarily an enlarged detail of the system illustrated in FIG. 1 somewhat later in the slicing operation;

FIG. 6 illustrates fragmentarily an enlarged perspective view of a detail of the system illustrated in FIG. 1, prior to the beginning of a slicing operation;

FIG. 7 illustrates an enlarged fragmentary plan view of a detail of the system illustrated in FIG. 1;

FIG. 8 illustrates an exploded perspective view of a detail of the system illustrated in FIG. 1;

FIG. 9 illustrates an alternative detail to the detail illustrated in FIG. 6; and, FIG. 10 illustrates an alternative detail to the detail illustrated in FIG. 7.

Referring now to FIG. 1 a veneer slicing and stacking operation 10 is illustrated in side elevation. A generally square cross section, rotary flitch carriage 12 has four flitch holding stations 14, 16, 18 and 20. A flitch 22, 24, 26, 28 is held at each station 14, 16, 18, 20, respectively, by slicer dogs 32 of a configuration which will subsequently be discussed in greater detail. Flitch carriage 12 is also coupled to a prime mover (not shown) which rotates flitch carriage 12 at a controlled rate of, for example, ≅25 rpm about its axis 36. A carriage 40 supports a knife and pressure bar assembly 42 of known configuration.

Carriage 40 moves synchronously with flitch carriage 12 in several ways. First, carriage 40 steps linearly toward flitch carriage 12 once each complete rotation of flitch carriage 12. The size of each such step is determined by the desired thicknesses of the sheets 44 of veneer which are to be sliced from flitches 22, 24, 26, 28 as flitch carriage 12 rotates. A second motion, Which is superimposed on the first, is a back-and-forth reciprocation of carriage 40, continuously synchronized to the rotation of flitch carriage 12. In other words, this second, reciprocating, motion is not simply a step toward flitch carriage 12 once each complete rotation of flitch carriage 12. Rather, this second motion reconciles the radial position of the knife and pressure bar assembly 42 with respect to the axis 36 of flitch carriage 12 on the one hand with the desired transverse sectional profiles of the sheets 44 of veneer on the other. For example, FIG. 3*a* illustrates somewhat exaggerated a convexly bowed profile cut 50 on a flitch 52. This cut 50 produces slightly outwardly bowed sheets of veneer after the first sheet has been taken off. This cut 50 requires either no additional motion or only a slight reciprocating motion of carriage 40 toward axis 36 to be made at a fairly linear rate from the time the flitch 52 engages knife 54 until knife 54 reaches the halfway point 56 in its cut. Then knife 54 is reciprocated in the same fashion away from axis 36.

FIG. 3*b* illustrates in somewhat exaggerated fashion a flat profile cut 60 on a flitch 62. This cut 60 produces flat sheets of veneer after the first sheet has been taken off. This cut 60 requires slightly more reciprocation of carriage 40 toward axis 36 than did cut 50 of FIG. 3*a*. However, again, the reciprocation can be made at a fairly linear rate from the time the flitch 62 engages knife 64 until knife 64 reaches the halfway point 66 in its cut. Then knife 64 is reciprocated at the same rate away from axis 36.

FIG. 3*c* illustrates in somewhat exaggerated fashion a concavely bowed profile cut 70 on a flitch 72. This cut 70 produces slightly concavely bowed sheets of veneer after the first sheet has been taken off. This cut 70 requires slightly more reciprocation of carriage 40 toward axis 36 than did cut 60 of FIG. 3*b*. However, again, the reciprocation can be made at a fairly linear rate from the time the flitch 72 engages knife 74 until knife 74 reaches the halfway point 76 in its cut. Then knife 74 is reciprocated at the same rate away from axis 36.

It is customary to maintain all of the veneer slices from a flitch 22, 24, 26, 28 together for sale. This is desirable because the coloring and grain texture vary somewhat from tree to tree and, if veneer slices are to be used in the manufacture of, for example, an article of furniture, it would not be desirable to mix colors and grain textures on finished surfaces of that article of furniture. To that end, a stacker 80 according to the invention separately stacks the veneer sheets 44 from the four different flitches 22, 24, 26, 28 in four stacks 82, 84, 86, 88, respectively. To accomplish this objective, the sheets 44 are conveyed upward from carriage 40 by a short section 90 of conveyor from which they are transferred between two facing conveyor 92, 94 runs. The sheets 44 are conveyed between conveyor 92, 94 runs to a point 96 at which conveyor 94 returns. Conveyor 92 passes beneath a vacuum box 100 which contains controlled vacuum dampers (not shown). Conveyor 92 continues to carry sheets 44 back toward carriage 40 until a particular sheet 44 is positioned over the stack 82, 84, 86, 88 of sheets sliced from its respective flitch 22, 24, 26, 28. As each sheet 44 reaches this position, a vacuum damper over it operates, releasing that sheet from conveyor 92 and depositing it in its correct order on its respective stack 82, 84, 86, 88. When slicing of flitches 22, 24, 26, 28 is complete, the respective stacks 82, 84, 86, 88 are removed for further processing, such as drying and new flitches are mounted on carriage 12.

FIG. 2 illustrates a generally triangular cross section, rotary flitch carriage 112 having stations 114, 116 and 118 for holding three flitches 122, 124 and 126 for slicing. Similar carriages can be provided for simultaneously slicing any practical number of flitches.

It should be understood that the control system for controlling the motion of carriage 40 must be capable of accounting not only for the desired veneer slice 44 thickness and profile 50, 60, 70. It must also take into account that as the flitches 22, 24, 26, 28 are sliced, the rate of rotation of the flitch carriage 12 may need to be reduced to maintain a constant surface angular velocity past the knife and pressure bar assembly 42. The controller must also take into account that, owing to the increasing width of each flitch 22, 24, 26, 28 nearer the rotary flitch holder 12, contact between the flitch 22, 24, 26, 28 and the knife and pressure bar assembly 42 will occur sooner in each successive rotation of the carriage 12, and will terminate later in each successive rotation of the carriage 12. The controller can sense slight changes in the rate of rotation of flitch carriage 12 when the knife and pressure bar assembly 42 contacts, and while it remains in contact with, a flitch which is being sliced. Control systems which serve these functions are known. Reference is here made to the above-noted control system disclosures, which are hereby incorporated herein by reference.

Turning now to FIGS. 4–8, each position 14, 16, 18, 20 on carriage 12 is provided with a plurality, illustratively sixteen, of dogs 32 for holding a respective flitch 22, 24, 26, 28 for slicing. Position 14 and flitch 22 are illustrated in greater detail in FIGS. 4 and 6. A stainless steel backing plate 130 is provided at each of the flitch-mounting positions 14, 16, 18, 20. Typically, the backing plates 130 are bolted to the carriage 12 by corrosion-resistant bolts, and the spaces between the bolts and plate 130 are filled with an inert epoxy. These steps and materials are necessary to avoid corrosion of the backing plates 130, the bolts and, to the extent possible, the carriage 12 by acids produced as the flitches 22, 24, 26, 28 are prepared for slicing. A driveshaft 132 protrudes through a bearing opening 134 provided therefor at each of the sixteen locations on backing plate 130. A pinion gear 136 is provided on each driveshaft 132 adjacent the surface 138 of each backing plate 130 remote from its flitch-mounting surface 140. Dogs 32 are divided into four longitudinally extending groups of four and a drive rod 142 with rack sections 144 fixed thereto extends longitudinally adjacent each group of four dogs 32. The rack sections 144 engage respective pinion gears, and the drive rods 142 which drive adjacent groups of pinion gears 136 are on opposite sides of their respective groups. See FIGS. 4–5.

As best illustrated in FIG. 8, each driveshaft 132 has a reduced-size square head 148. Each dog 32 has a square cross-section socket for receiving the square head 148 of its respective driveshaft 132 to mount the dogs 32 non-rotatably on their respective driveshafts 132. Each dog 32 also has a countersunk opening 150 provided in its outer, flat surface 152 to receive a fastener 154 for attaching the dog 32 to the shaft 132. The dogs 32 are sharp-edged and are somewhat elliptical in plan view. During the preparation of the flitch 14, 16, 18, 20 for slicing, the back surface 156 of the flitch is provided with four grooves 158 whose width is the same length as, or slightly larger than, the minor axis of the dog 32. In no event should the width of the groove 158 be greater than the major axis of the dog 32. The back surface 156 is also provided with a saw cut 160 at the midpoint of its width. The depth of the saw cut 160 will vary depending upon the hardness of the wood and the tightness of the grain. Generally, however, the depth of the saw cut 160 will range somewhere between 3 inches and 6 inches (7.62 cm and 15.24 cm).

Once the flitch 14, 16, 18, 20 is positioned properly on its respective backing plate 130, the associated drive mechanisms, illustrated as hydraulic cylinders 164 in FIG. 7 are actuated. This drives the pair of drive rods 142 which are coupled to each cylinder 164 lengthwise of the flitch, turning the pinions 136 associated with each drive rod 142 a quarter turn, causing the sharp edges of the dogs 32 to dig into the walls of each groove 158. Because the rods 142 are on opposite sides of the pinions 136 of adjacent pairs, the forces exerted by the dogs 32 on the flitch are balanced and there is no tendency to drive the flitch in either direction on the mounting plate 130.

Slicing of the flitch proceeds as previously discussed until the knife and pressure bar assembly 42 reaches the saw cut 160. At that time, rotation of the carriage 12 is stopped and one 170 of the two resulting pieces 170, 172 is turned end for end and re-mounted on the mounting plate 130 so that the grains of both pieces 170, 172 extend in the same direction. This reduces the likelihood of opening up the grain of the veneer that is sliced from pieces 170, 172 during the late stages of the slicing operation.

Turning now to an alternative construction of the flitch table at each of positions 14, 16, 18, 20, in FIGS. 9–10 each position 14, 16, 18, 20 on a carriage 12 is provided with a plurality, illustratively thirty-two, of dogs 32 for holding a respective flitch 22, 24, 26, 28 for slicing. Position 14 and flitch 22 are illustrated in greater detail in FIGS. 9 and 10. A stainless steel backing plate 230 is provided at each of the flitch-mounting positions 14, 16, 18, 20. Typically, the backing plates 230 are bolted to the carriage 12 by corrosion-resistant bolts, and the spaces between the bolts and plate 230 are filled with an inert epoxy. These steps and materials are necessary to avoid corrosion of the backing plates 230, the bolts and, to the extent possible, the carriage 12 by acids produced as the flitches 22, 24, 26, 28 are prepared for slicing. A driveshaft 232 protrudes through a bearing opening 234 provided therefor at each of the thirty-two locations on backing plate 230. A pinion gear 236 is provided on each driveshaft 232 on the side thereof opposite flitch-mounting surface 240. Dogs 32 are divided into four longitudinally extending groups of eight and a drive rod 242 with rack sections 244 provided on opposite sides thereof extends longitudinally between two adjacent groups of eight dogs 32. The rack sections 244 engage respective pinion gears of the two adjacent groups. Actuation of the drive rods 242 drives adjacent groups of pinion gears 236 in opposite rotational directions.

During the preparation of the flitch 14, 16, 18, 20 for slicing, the back surface 156 of the flitch is provided with four grooves 158 whose width is the same length as, or slightly larger than, the minor axis of the dog 32. In no event should the width of the groove 158 be greater than the major axis of the dog 32. The back surface 156 is also provided with a saw cut 160 at the midpoint of its width. The depth of the saw cut 160 will vary depending upon the hardness of the wood and the tightness of the grain. Generally, however, the depth of the saw cut 160 will range somewhere between 3 inches and 6 inches (7.62 cm and 15.24 cm).

The backing plate 230 in the embodiment illustrated in FIGS. 9–10 is provided with guide rail segments 246 extending longitudinally between adjacent dogs 32. Enough space is provided between the adjacent ends 248 of segments 246 to permit the full pivoting dogging movement of dogs 32 by the previously described drive mechanism. The widths of grooves 158 are just enough larger than the widths of rail segments 246 to promote easy mounting of prepared flitches 14, 16, 18, 20 onto backing plate 230. The guide rail segments 246 extend above the surrounding surface of the backing plate 230 to a height illustratively slightly less than the uniform depth of the grooves 158. Guide rail segments 246 help unload some of the stress which otherwise would be borne by dogs 32 during loading and slicing of the flitches 14, 16, 18 and 20. The guide rail segments 246 also help protect the dogs 32 during mounting of the flitch 14, 16, 18, 20, to, and removal of remnants of the flitch 14, 16, 18, 20 from, the carriage 12 before, and during and after slicing, respectively.

Once the flitch 14, 16, 18, 20 is positioned properly on its respective backing plate 230, the associated drive mechanisms 264 are actuated. This drives the drive rod 242 which is coupled to that cylinder 264 lengthwise of the flitch, turning the pinions 236 associated with that drive rod 242 a quarter turn, causing the sharp edges of the dogs 32 to dig into the walls of each groove 158. Because the racks 244 are on opposite sides of the same drive rod 242, the forces exerted by the dogs 32 on the flitch are balanced and there is no tendency to drive the flitch in either direction on the mounting plate 230.

Slicing of the flitch proceeds as previously discussed until the knife and pressure bar assembly 42 reaches the saw cut 160. At that time, rotation of the carriage 12 is stopped and one 170 of the two resulting pieces 170, 172 is turned end for end and re-mounted on the mounting plate 230 so that the grains of both pieces 170, 172 extend in the same direction. This reduces the likelihood of opening up the grain of the veneer that is sliced from pieces 170, 172 during the late stages of the slicing operation.

What is claimed is:

1. A flitch table for mounting a flitch for slicing of veneer from the flitch by a knife, the flitch including a mounting side which lies adjacent the table when the flitch is mounted to the table, the mounting side including an opening, the table including a dog for projecting into the opening when the flitch is mounted to the table to fix the flitch to the table for slicing of the flitch, the dog having a flitch fixing position in which the flitch is fixed to the table by the dog and a flitch releasing position in which the flitch is not fixed to the table by the dog, and means for driving the dog between the fixing and releasing positions.

2. The apparatus of claim 1 wherein the dog comprises a dogging portion for engaging the flitch adjacent the opening when the dog is in the fixing position.

3. The apparatus of claim 2 wherein the drive means comprises a drive shaft for rotating the dog between the fixing position and the releasing position.

4. The apparatus of claim 3 wherein the dog comprises an oval shaped head portion, the dogging portion comprising the region of the head portion adjacent either end of the major axis of the oval shaped head portion, the drive shaft mounting the dog adjacent the intersection of the major and minor axes of the head portion.

5. The invention of claim 3 wherein the opening comprises a groove extending generally transversely to the direction of relative movement between the flitch and the knife during the slicing of veneer.

6. The apparatus of claim 5 wherein there are a plurality of dogs and a plurality of drive shafts, the dogs spaced along the length of the groove when the flitch is mounted on the table.

7. The apparatus of claim 6 wherein the drive means substantially simultaneously drives all of the dogs between their fixing positions and their releasing positions.

8. The apparatus of claim 6 wherein the flitch table further comprises a guide rail extending between adjacent dogs, the guide rail extending into the groove between the locations at which said adjacent dogs extend into the groove when the flitch is mounted on the table.

9. The invention of claim 5 wherein the flitch comprises a plurality of such grooves extending generally parallel to each other.

10. The apparatus of claim 9 wherein there are a plurality of dogs and a plurality of drive shafts, the dogs arranged in rows, each row of dogs extending along the length of one of the grooves when the flitch is mounted on the table.

11. The apparatus of claim 10 wherein the drive means substantially simultaneously drives all of the dogs between their fixing positions and their releasing positions.

12. The apparatus of claim 10 wherein the flitch table comprises guide rails extending between adjacent dogs along the length of one of the grooves when the flitch is mounted on the table, the guide rails extending into respective ones of the grooves between the locations at which said adjacent dogs extend into the respective grooves when the flitch is mounted on the table.

13. A flitch table for mounting a flitch for slicing of veneer from the flitch by a knife, the flitch including a mounting side which lies adjacent to the table when the flitch is mounted to the table, the mounting side including a groove extending generally transversely of the direction of relative movement between the flitch and the knife during the slicing of veneer, the table including means defining a guide rail for projecting into the groove when the flitch is mounted to the table.

14. The apparatus of claim 13 and further comprising a dog for fixing the flitch on the table, the dog having a flitch fixing position in which the flitch is fixed to the table by the dog and a flitch releasing position in which the flitch is not fixed to the table by the dog, and a drive shaft for driving the dog between the fixing and releasing positions.

15. The invention of claim 14 wherein the flitch comprises a plurality of such grooves extending generally parallel to each other.

16. The apparatus of claim 15 wherein there are a plurality of guide rails for projecting into the grooves when the flitch is mounted to the table.

17. The apparatus of claim 16 wherein there are a plurality of dogs, the dogs arranged in rows, each row of dogs extending along a guide rail.

* * * * *